US008526658B1

(12) United States Patent
Houston

(10) Patent No.: US 8,526,658 B1
(45) Date of Patent: Sep. 3, 2013

(54) MUSICAL TRAVEL CAP ASSEMBLY

(76) Inventor: Inez Houston, Baltimore, MD (US)

( * ) Notice: Subject to any disclaimer, the term of this patent is extended or adjusted under 35 U.S.C. 154(b) by 17 days.

(21) Appl. No.: 13/305,169

(22) Filed: Nov. 28, 2011

(51) Int. Cl.
*H04R 25/00* (2006.01)

(52) U.S. Cl.
USPC ..... 381/376; 381/301; 381/333; 381/367; 381/388

(58) Field of Classification Search
USPC ..... 381/301, 332–333, 367, 370–372, 381/374, 376, 388; 2/209, 905
See application file for complete search history.

(56) References Cited

U.S. PATENT DOCUMENTS 1,354,524 A * 10/1920 Timmons ..... 381/376
4,776,044 A * 10/1988 Makins ..... 381/376
4,833,726 A * 5/1989 Shinoda et al. ..... 381/376
4,858,248 A * 8/1989 Goldsmith et al. ..... 2/209.13
5,243,709 A 9/1993 Sheehan et al.
6,154,890 A * 12/2000 Deopuria et al. ..... 381/376
D495,057 S 8/2004 McCoy
2003/0103633 A1 6/2003 Metcalfe, III
2004/0226079 A1 11/2004 Rainey
2006/0062416 A1* 3/2006 Wu ..... 381/376
2008/0144872 A1 6/2008 Phillips
2008/0181429 A1* 7/2008 Fried ..... 381/87
2008/0295224 A1* 12/2008 Mintzer ..... 2/209.13
2010/0054491 A1 3/2010 Griffin
2011/0286620 A1* 11/2011 Flynn ..... 381/388

* cited by examiner

*Primary Examiner* — Suhan Ni

(57) ABSTRACT

A musical travel cap assembly provides music to sooth a child while traveling. The assembly includes a main body having a crown section and opposed ear sections extending from the crown section. A pair of speakers is provided with each the speaker being positioned adjacent to an interior surface of the main body. Each speaker is further positioned adjacent to an associated one of the ear sections. A pocket is coupled to the main body and a music player is positioned in the pocket. The music player is operationally coupled to the speakers whereby music from the music player is played through the speakers.

8 Claims, 4 Drawing Sheets

MUSICAL TRAVEL CAP ASSEMBLY

BACKGROUND OF THE DISCLOSURE

Field of the Disclosure

The disclosure relates to cap devices and more particularly pertains to a new cap device for providing music to sooth a child while traveling.

SUMMARY OF THE DISCLOSURE

An embodiment of the disclosure meets the needs presented above by generally comprising a main body having a crown section and opposed ear sections extending from the crown section. A pair of speakers is provided with each the speaker being positioned adjacent to an interior surface of the main body. Each speaker is further positioned adjacent to an associated one of the ear sections. A pocket is coupled to the main body and a music player is positioned in the pocket. The music player is operationally coupled to the speakers whereby music from the music player is played through the speakers.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
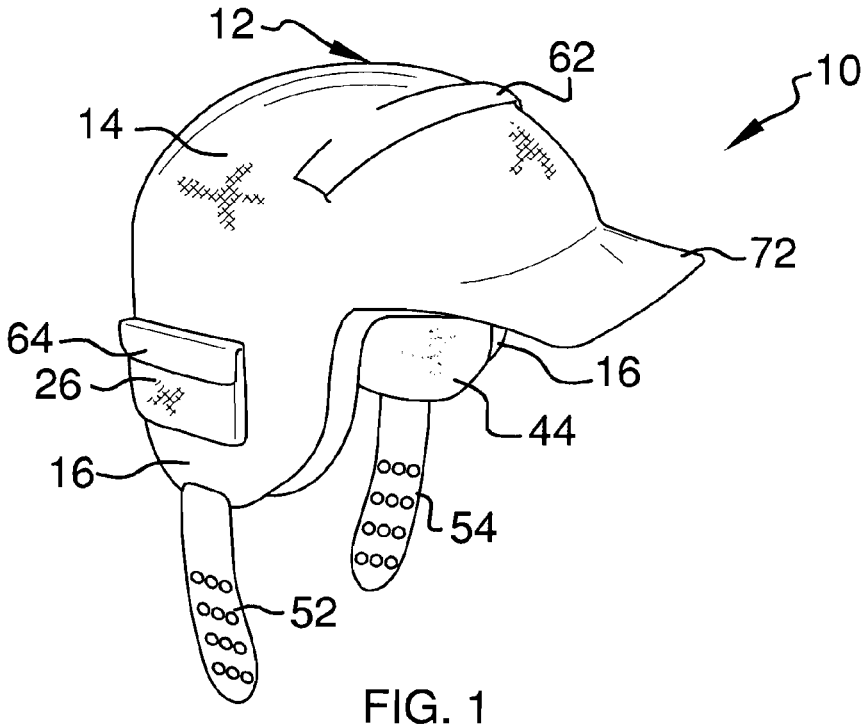
FIG. 1 is a top front side perspective view of a musical travel cap assembly according to an embodiment of the disclosure.
Figure 2:
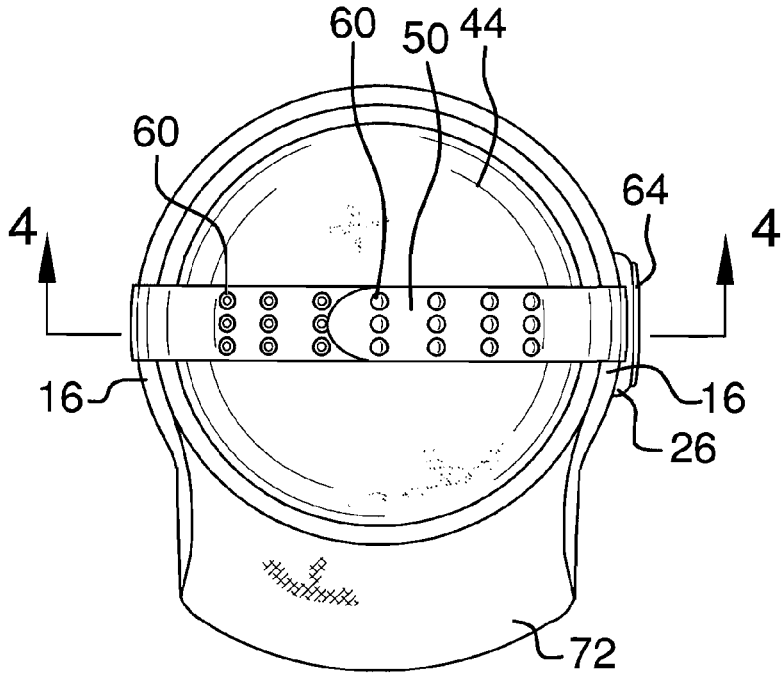
FIG. 2 is a bottom view of an embodiment of the disclosure.
Figure 3:
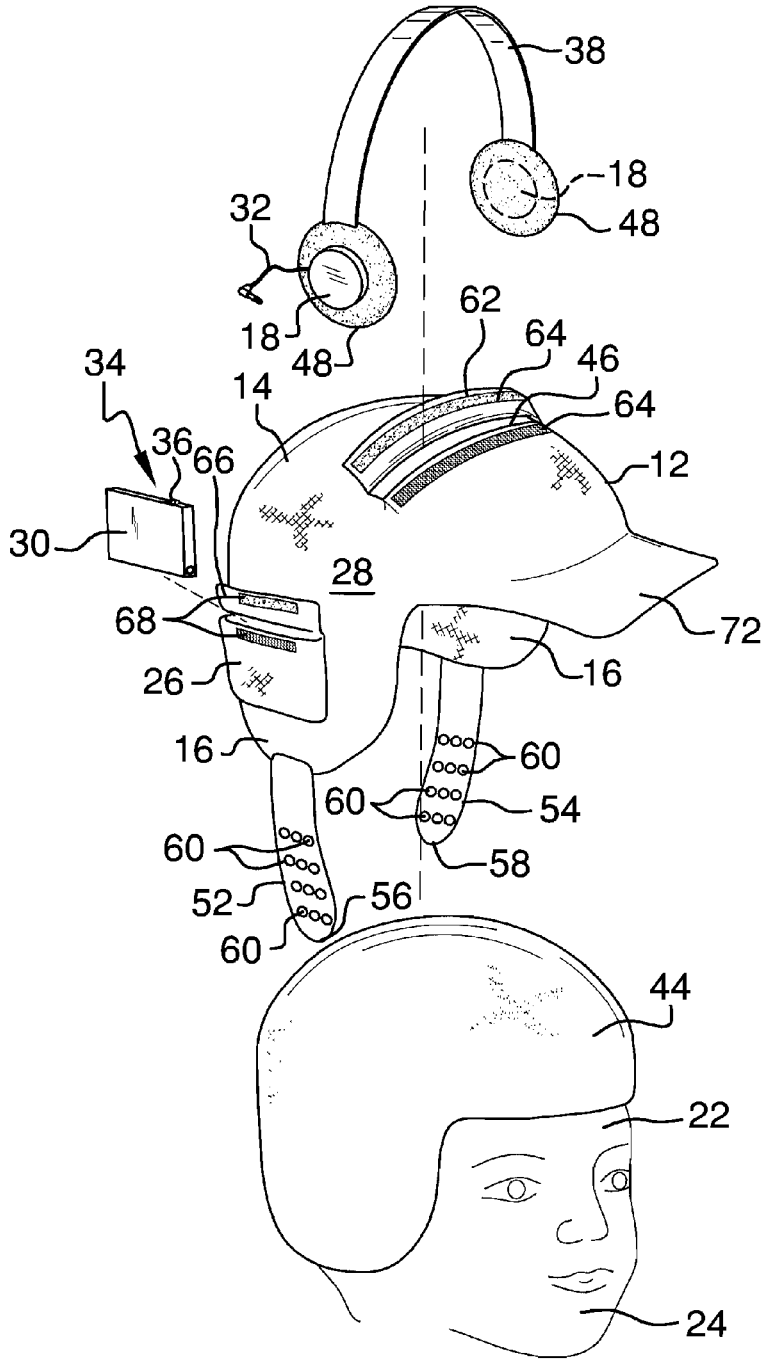
FIG. 3 is an exploded top front side perspective view of an embodiment of the disclosure.
Figure 4:
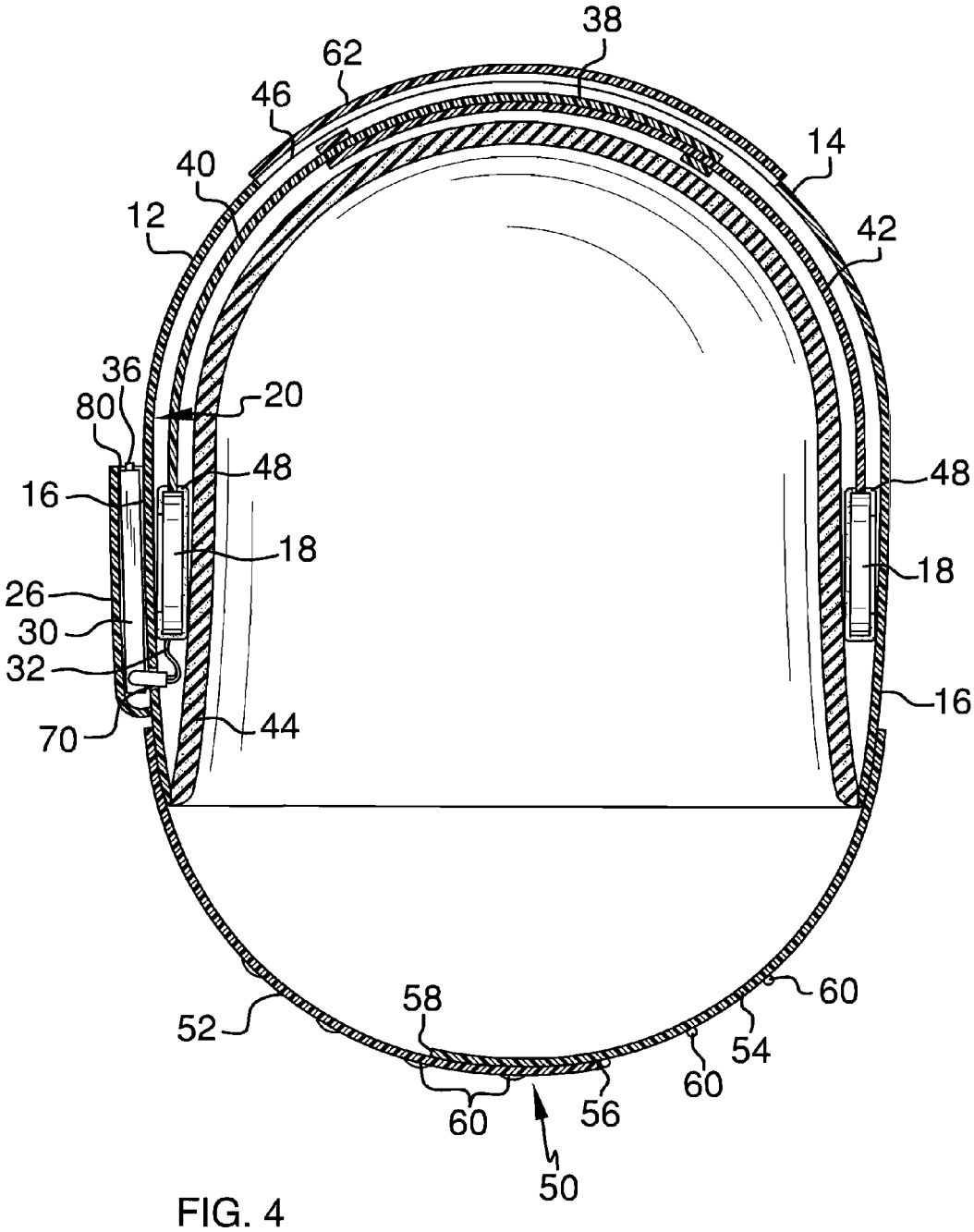
FIG. 4 is a cross-sectional view of an embodiment of the disclosure taken along line 4-4 of FIG. 2.
Figure 5:
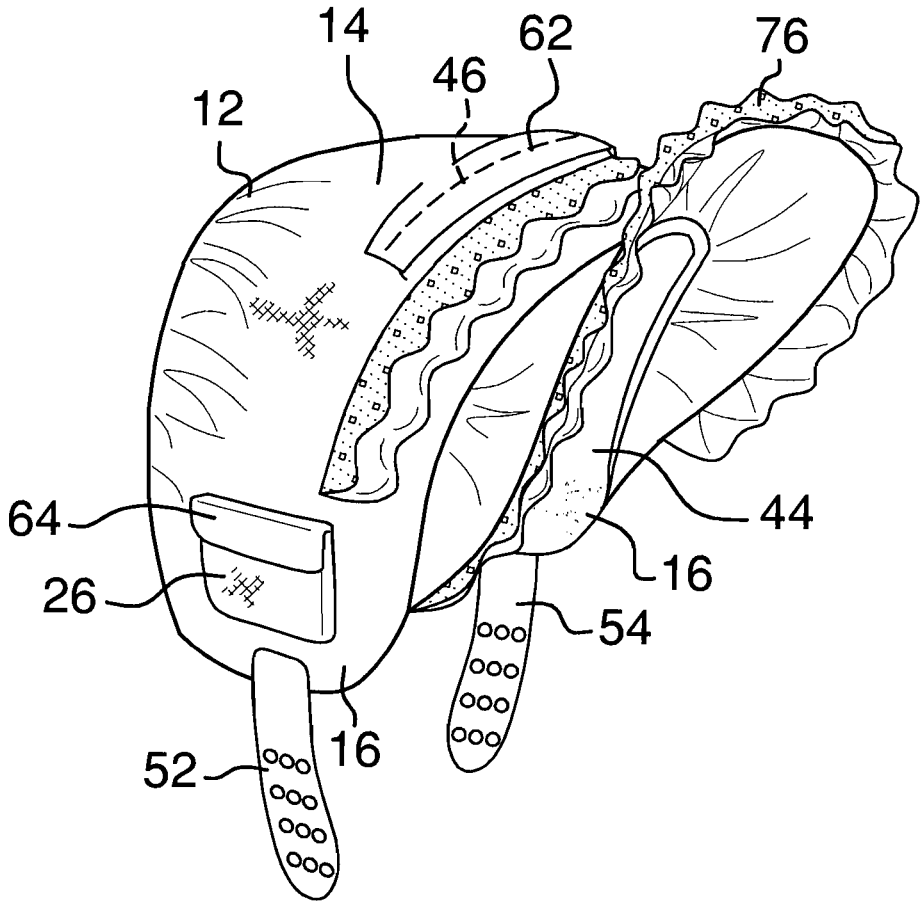
FIG. 5 is a top front side perspective view of an embodiment of the disclosure.

With reference now to the drawings, and in particular to FIGS. 1 through 5 thereof, a new cap device embodying the principles and concepts of an embodiment of the disclosure and generally designated by the reference numeral 10 will be described.

As best illustrated in FIGS. 1 through 5, the musical travel cap assembly 10 generally comprises a main body 12 configured for fitting on a head 22 of a user 24. The main body 12 has a crown section 14 and opposed ear sections 16 extending from the crown section 14. A pair of speakers 18 is provided.

Each speaker 18 is removably positioned adjacent to an interior surface 20 of the main body 12 facing inwardly. Each speaker 18 is further positioned adjacent to an associated one of the ear sections 16 whereby the speakers 18 are configured for delivering sound to the ears of a user wearing the assembly 10.

A pocket 26 is coupled to an outer surface 28 of the main body 12. A music player 30 may be positioned in the pocket 26. The music player 30 is operationally coupled to the speakers 18 using a wire 32 whereby music from the music player 30 is played through the speakers 18. The music player 30 includes operational controls 34 which may be a single button 36 to facilitate operation of the music player 30 while positioned in the pocket 26. The button 36 may be positioned at a top 80 of the music player 30 to permit pressing of the button 80 without applying lateral pressure against the head 22 of the user 24.

A band 38 may be coupled to and extend between the speakers 18. The band 38 may be constructed of plastic, rubber, or a jelly type material to facilitate comfort for the user 24. The band 38 may also have a first portion 40 slidably coupled to a second portion 42 whereby a length of the band 38 is adjustable.

A liner 44 is coupled to and covers the interior surface 20 of the main body 12. A slit 46 may be positioned in a top 48 of the crown section 14 whereby the speakers 18 and the band 38 are insertable through the slit 46 to a position between the main body 12 and the liner 44. A pair of pads 48 may be coupled to the speakers 18, each pad 48 positioned over an associated one of the speakers 18.

As the primary use is directed to soothing small children while traveling, particularly in situations such as a pressurized plane cabin, a chin strap 50 may be coupled to and extending between the ear sections 16. The chin strap 50 has a first end section 52 and a second end section 54. The first end section 52 has a distal end 56 relative to the main body 12 and the second end section 54 has a distal end 58 relative to the main body 12. The distal end 56 of the first end section 52 is selectively couplable to the distal end 58 of the second end section 54. A plurality of complementary snaps 60 extend along the first end section 52 and the second end section 54 such that the first end section 52 is selectively couplable to the second end section 54. Thus, a length of the chin strap 50 extending between the ear sections 16 is adjustable to secure the assembly 10 to the user 24.

A flap 62 extends from the crown section 14 of the main body 12 adjacent to the slit 46. The flap 62 may be elongated and selectively couplable to the crown section 14 using hook and loop fastener 64 whereby the flap 62 covers the slit 46 securing the speakers 18 and band 38 between the liner 44 and the main body 12. Similarly, an overlap 66 may be provided adjacent to the pocket 26 secured by hook and loop fastener 68 to secure the music player 30 within the pocket 26. An opening 70 may be provided through the main body 12 into the pocket 26 to permit the wire 32 to be coupled between the speakers 18 and the music player 30 without exposing the wire 32.

The main body 12 may be designed or styled with a bill 72 or ruffle 74 in the style of conventional caps or bonnets selectable to correspond to the gender of the user 24 if so desired.

In use, the main body 12 is positioned on the head 22 of the user 24. The speakers 18 and band 38 are positioned between the main body 12 and the liner 44 with the speakers 18 adjacent to the ears of the user 24. The wire 32 is passed through the opening 70 and coupled to the music player 30. The music player 30 may be electronic using an MP3 or similar format. Alternatively, the music player 30 may be in the form of a winding music box. The main body 12 is secured to the user 24 using the chin strap 50. The intended use is to soothe a small child with music while traveling, particularly during flights involving a pressurized cabin.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A cap assembly for soothing a child while traveling, said cap assembly comprising:

a main body having a crown section and opposed ear sections extending from said crown section;

a pair of speakers, each said speaker being positioned adjacent to an interior surface of said main body, each said speaker being positioned adjacent to an associated one of said ear sections;

a pocket coupled to said main body;

a music player positioned in said pocket, said music player being operationally coupled to said speakers whereby music from said music player is played through said speakers;

a band coupled to and extending between said speakers;

a liner coupled to and covering said interior surface of said main body; and a slit positioned in a top of said crown section whereby said speakers and said band are insertable through said slit to a position between said main body and said liner.

2. The assembly of claim 1, further including a pair of pads, each said pad being coupled to an associated one of said speakers.

3. The assembly of claim 1, further including a chin strap coupled to and extending between said ear sections.

4. The assembly of claim 3, further including said chin strap having a first end section and a second end section, said first section having a distal end relative to said main body, said second end section having a distal end relative to said main body, said distal end of said first section being selectively couplable to said distal end of said second end section.

5. The assembly of claim 4, further including a plurality of complementary snaps extending along said first end section and said second end section such that said first end section is selectively couplable to said second end section whereby a length of said chin strap extending between said ear sections is adjustable.

6. The assembly of claim 1, further including a flap extending from said crown section of said main body adjacent to said slit, said flap being selectively couplable to said crown section whereby said flap covers said slit.

7. The assembly of claim 1, further including said band having a first portion slidably coupled to a second portion whereby a length of said band is adjustable.

8. A cap assembly for soothing a child while traveling, said cap assembly comprising:

a main body having a crown section and opposed ear sections extending from said crown section;

a pair of speakers, each said speaker being positioned adjacent to an interior surface of said main body, each said speaker being positioned adjacent to an associated one of said ear sections;

a pocket coupled to said main body;

a music player positioned in said pocket, said music player being operationally coupled to said speakers whereby music from said music player is played through said speakers;

a band coupled to and extending between said speakers, said band having a first portion slidably coupled to a second portion whereby a length of said band is adjustable;

a liner coupled to and covering said interior surface of said main body;

a slit positioned in a top of said crown section whereby said speakers and said band are insertable through said slit to a position between said main body and said liner;

a pair of pads, each said pad being coupled to an associated one of said speakers;

a chin strap coupled to and extending between said ear sections, said chin strap having a first end section and a second end section, said first section having a distal end relative to said main body, said second end section having a distal end relative to said main body, said distal end of said first section being selectively couplable to said distal end of said second end section;

a plurality of complementary snaps extending along said first end section and said second end section such that said first end section is selectively couplable to said second end section whereby a length of said chin strap extending between said ear sections is adjustable; and a flap extending from said crown section of said main body adjacent to said slit, said flap being selectively couplable to said crown section whereby said flap covers said slit.

* * * * *